US005615621A

United States Patent [19]

Mengshoel et al.

[11] Patent Number: 5,615,621

[45] Date of Patent: Apr. 1, 1997

[54] ARRANGEMENT IN A STRUCTURAL ELEMENT FOR EXAMPLE FOR USE IN A FURNITURE, MORE SPECIALLY A SITTING FURNITURE OR RELIEF FURNITURE

[76] Inventors: Hans C. Mengshoel, Prinsessealléen 7, N-0275 Oslo, Norway; Oddvin Rykken, Postboks 8778 Youngstorget, N-0028 Oslo, Norway

[21] Appl. No.: 302,902

[22] PCT Filed: Apr. 2, 1993

[86] PCT No.: PCT/NO93/00054

§ 371 Date: Sep. 16, 1994

§ 102(e) Date: Sep. 16, 1994

[87] PCT Pub. No.: WO93/19640

PCT Pub. Date: Oct. 14, 1993

[30] Foreign Application Priority Data

Apr. 2, 1992 [NO] Norway ..... 92.1285

[51] Int. Cl.[6] ..... A47B 3/06

[52] U.S. Cl. ..... 108/193; 108/157; 108/101; 108/150; 297/440.13; 248/188.7

[58] Field of Search ..... 108/180, 183, 108/186, 191, 193, 155, 157, 92, 101, 159, 150, 66; 297/440.13; 248/431, 529, 165, 188.7

[56] References Cited

U.S. PATENT DOCUMENTS

| | | | |
|---|---|---|---|
| 401,798 | 4/1889 | Spencer | 297/440.13 X |
| 1,047,882 | 12/1912 | Beach | 248/165 X |
| 1,903,631 | 4/1933 | Morrison | 108/157 X |
| 1,940,117 | 12/1933 | Carpos . | |
| 2,435,132 | 1/1948 | D'Horaene | 108/101 |
| 2,444,991 | 7/1948 | Hunter | 297/440.13 |
| 3,572,824 | 3/1971 | Schupbach | 297/440.13 X |
| 3,990,663 | 11/1976 | Hendrickson et al. | 248/188.7 |
| 4,646,655 | 3/1987 | Robolin | 108/101 X |
| 4,825,781 | 5/1989 | Palmer | 108/150 X |
| 5,088,419 | 2/1992 | Hartwell et al. | 108/66 |
| 5,363,772 | 11/1994 | Adamidis | 108/66 |

FOREIGN PATENT DOCUMENTS

| | | | |
|---|---|---|---|
| 1175217 | 3/1959 | France | 108/92 |
| 2627964 | 9/1989 | France | 108/157 |
| 358286 | of 1973 | Sweden . | |
| 1365103 | 8/1974 | United Kingdom . | |
| 1421535 | 1/1976 | United Kingdom . | |
| 2203034 | 10/1988 | United Kingdom . | |
| WO81/02248 | 8/1981 | WIPO . | |

*Primary Examiner*—Peter M. Cuomo
*Assistant Examiner*—Janet M. Wilkens
*Attorney, Agent, or Firm*—Andrus, Sceales, Starke & Sawall

[57] ABSTRACT

A structural element, for use as a furniture support, includes a pair of support members, one of which defines an upwardly facing recess and the other of which defines a downwardly facing recess. Each support member is engaged within the recess of the other support member, for providing ease of disassembly. Each support member includes a pair of outwardly extending lower legs, which engage a supporting surface. Each support member further includes an upper support arm and an intermediate support arm located below the upper support arm and the legs. The upper support arms of the support members engage and support a first use surface, and the intermediate support arms engage and support a second use surface at an elevation between the first use surface and the legs. The structional element also contemplates a stabilizing structure for an assembled support post of the type described. The stabilizing structure is in the form of abutment surfaces which engage each other when the support members are assembled together. The abutment surfaces are non-parallel to a longitudinal plane along which each support member extends, and are also non-parallel to a transverse axis perpendicular to the longitudinal axis.

19 Claims, 7 Drawing Sheets

ARRANGEMENT IN A STRUCTURAL ELEMENT FOR EXAMPLE FOR USE IN A FURNITURE, MORE SPECIALLY A SITTING FURNITURE OR RELIEF FURNITURE

BACKGROUND OF THE INVENTION

The present invention relates to an arrangement in a structural element, for example in connection with furniture, especially sitting furniture or relief furniture, comprising at least a first and a second supporting means, each of which comprising an area having a recess, said recess being adapted such that said supporting means can be detachably engaged for mutual assemblage.

PRIOR ART

From SE, 258 286 (Ward) there is known a supporting means comprising at least four leg elements, provided with recesses and tracks, such that the leg elements can be assembled into at least two units, two and two leg elements being arranged in a cross and the crosses as such being assembled to a multi-leg supporting means.

Such a supporting means requires specific recesses in order to enabling mounting of pairs of legs in a cross, and furthermore it is in the area of the recesses required to provide tracks constituting a weakening of the material strength in the area of the crossing legs. Further, the prior art supporting means is limited to supporting one single horizontal use surface.

From GB 1 365 103 (Andrews) there is known a demountable structure for furniture, comprising first and second supporting members each being provided with channel- or rib-shaped grooved portions extending along an uninterrupted surface of each supporting member, the other half of each supporting member being equipped with a track, such that the supporting members can be detachably engaged, said channel/rib-shaped portions mutually engaging each other for further interconnection of the finished assembled elements. Neither does such a structure give any instructions for supporting more that one single horizontal use surface, even if it is suggested that the finished assembled structure can be assembled by three different supporting elements, but then with a central rod as a further stabilizing element.

From GB 1 421 535 (Finlator) there are known furniture frames assembled by two preferably H-shaped frame elements. A first embodiment includes the assembly of two similar H-shaped frame elements which in an assembled position renders support for one single horizontal use surface. This publication also instructs about H-shaped frame elements of different sizes, which means that there can be provided an assembled frame having upper portions of the largest H-shape constituting a holder for a chair back, whereas the smaller H-shaped frame element comprises pipe-shaped areas extending in opposite directions and constituting a holder for an individual chair seat. Such an assemblage of H-shaped frame elements will, however, not exhibit an inherent stability, the assemblage of the frames resulting in that the four central parallel rod portions cannot be stabilized as such in relation to each other without further auxiliary means. Besides, the small H-shaped frame element with its horizontally extending frame area will constitute a fragile and incomplete support for a chair seat.

GB 2 203 034 (Fraser) relates to a structure for furniture having a flat rectangular top which is supported by a column which is assembled by such elements as disclosed in the preamble of the present patent application. Also here there prior art technique is developed for only supporting one single horizontal use surface.

WO 81/02248 (Ehrlich) relates to a furniture structure, especially a long table of which the table plate itself is attached by means of specific gripping elements, for example velcro bands or similar.

Further publications related to the present technique comprise NO 154.783, NO 155.324, DE 3.444.957, U.S. Pat. Nos. 3,437,060, 3,545,387, 4,700,915 and U.S. Pat. No. 4,825,781.

OBJECT OF THE INVENTION

An object of the present invention is to provide structural elements or supporting means which in finished assembled condition in a simple and utility favourable manner can constitute the base for one or more use surfaces which can have different levels and take different mutual angles in relation to each other.

Yet an object of the present invention is to provide information about supporting means giving a specifically stable finished assembled structure, the elements included in the supporting means and the applied use surfaces themselves aiding in stabilizing the elements of the supporting means in a mutual relation.

An object of the present invention is also to give information about an arrangement which in disassembled condition requires small space for storage and transportation, and which upon assemblage requires no or simple tools, the assemblage at the same time being simple and easy to accomplish.

A further object of the present invention is to give information about an arrangement in a furniture structure which can easily harmonize with existing environments and at the same time satisfy a series of furniture related functions, for example provided as a stool, chair, kneeling-sitting chair, relief table, etc.

SUMMARY OF THE INVENTION

The above disclosed objects are achieved in an arrangement of the type as stated in the preamble, which according to the invention is characterized in that each supporting means comprises a first lower leg element pair extending in substantially pair-like mutually opposite directions, one or more intermediate supporting elements extending either from any individual supporting element, for example as arms or being attached at arbitrary level along at least two different supporting elements, and possibly one or more upper supporting elements extending either from any individual supporting element, for example as arms or being threaded onto at least two different supporting elements.

In order to further increase the stability of the assembled supporting means it is appropriate that each supporting element is provided with inclined surfaces which in mounted position rest against corresponding inclined surfaces of adjacent supporting means.

In a specific embodiment the arrangement is characterized in that one or more intermediate supporting elements are formed as intermediate arms extending in a first direction, and that one or more upper supporting elements are formed as upper arm elements extending substantially in opposite direction of the intermediate arm element, such that the supporting means in mutually assembled position comprise four lower leg elements in a cross, and two intermediately positioned arm elements extending outwardly for supporting a first use surface, as well as two upper arm elements extending outwardly for supporting a second use surface.

A further specific embodiment of the arrangement involves that it supports one or more use surfaces, the individual use surface being steplessly threaded onto different pairs of supporting means elements, and being constituted by a plate-shaped element having appropriate cut-outs fitting the outer profile of said supporting means elements.

BRIEF DISCLOSURE OF THE DRAWINGS

Further features and advantages of the present invention will appear from the following description taken in conjunction with the appending drawings.

Figure 13:
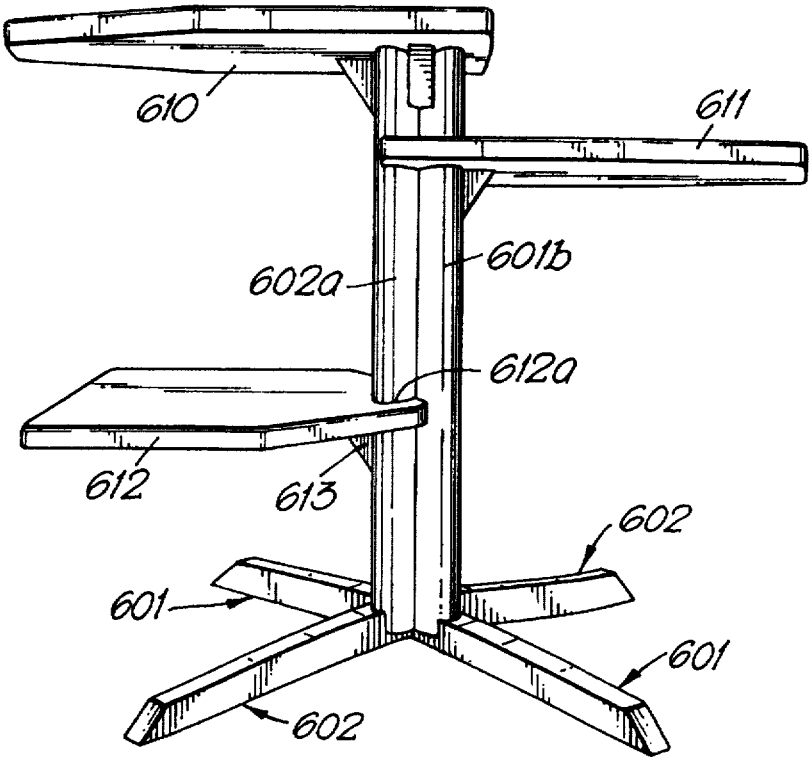
Figure 14:
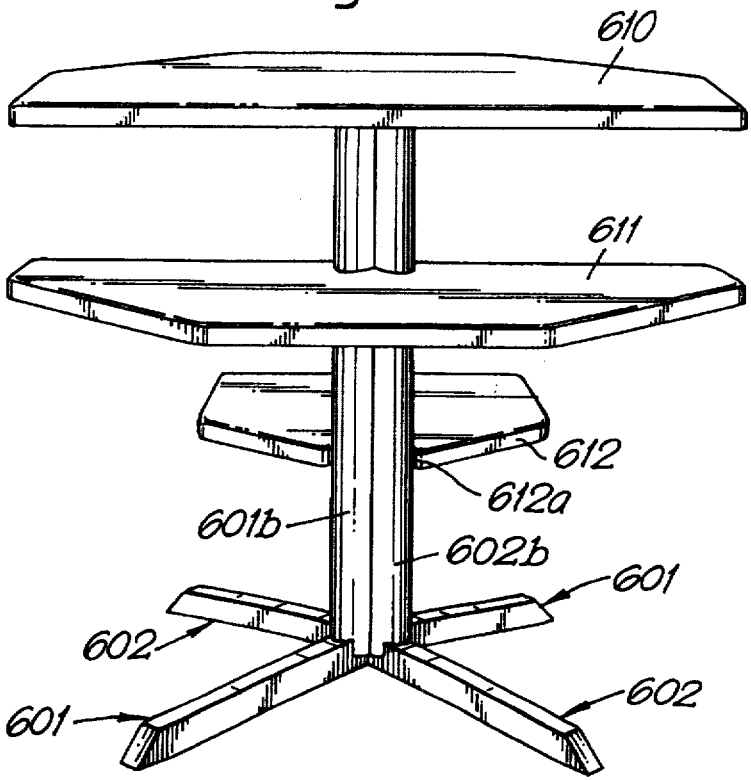
Figure 15:
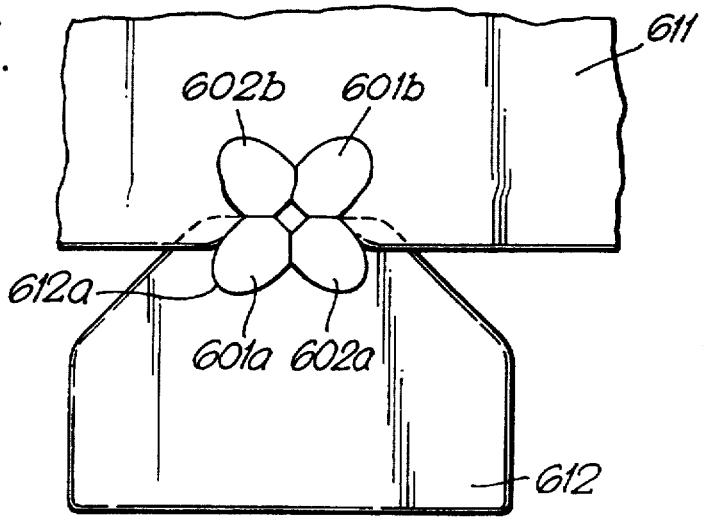

FIGS. 13–15 comprise side view, front view and top view with upper use surface removed, respectively, of a further embodiment of the arrangement according to the invention.

Figure 16:
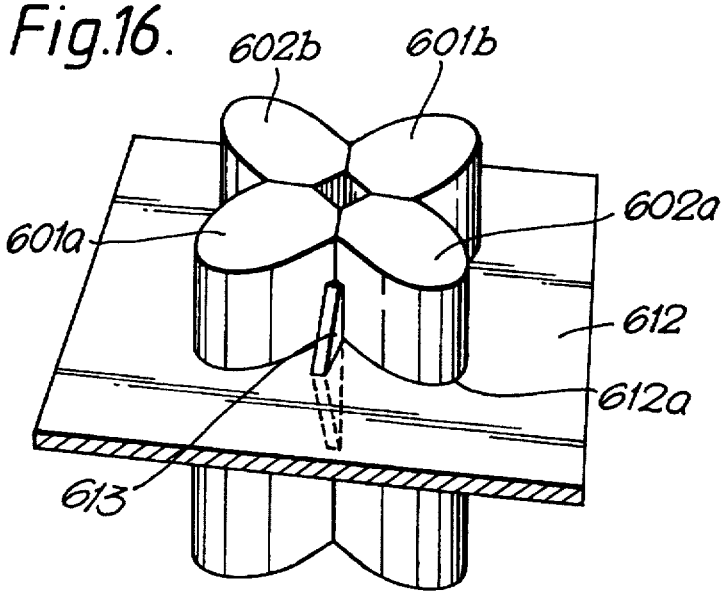

FIG. 16 is on a larger scale a perspective view of a cut-out of the embodiment illustrated in FIGS. 13–15.

Figure 17:
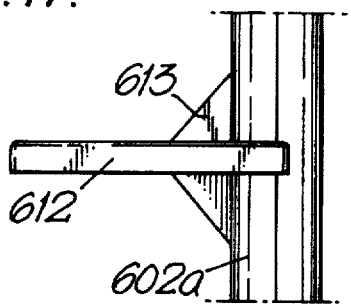

FIG. 17 is a side view of FIG. 16.

DISCLOSURE OF EMBODIMENTS

Figure 1:
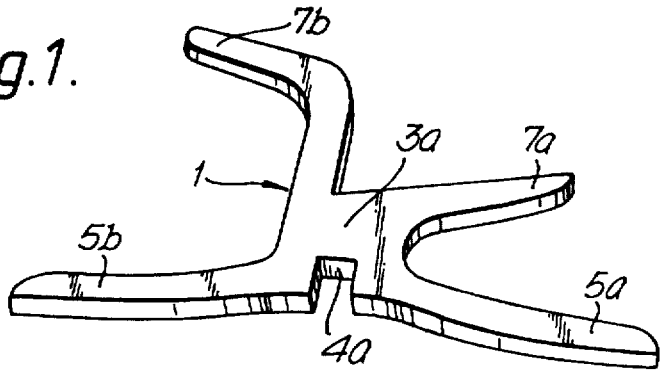
FIG. 1 is a perspective view of a first supporting means in an arrangement according to the invention.
Figure 2:
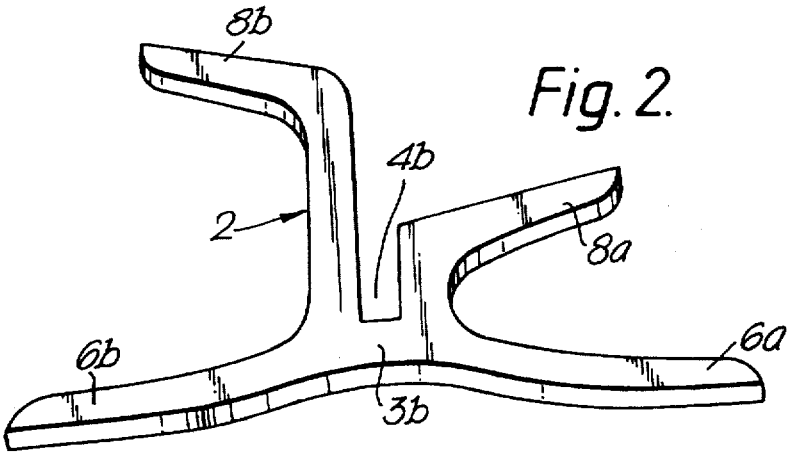
FIG. 2 is a perspective view of a second supporting means being comprised in an arrangement according to the invention.
Figure 3:
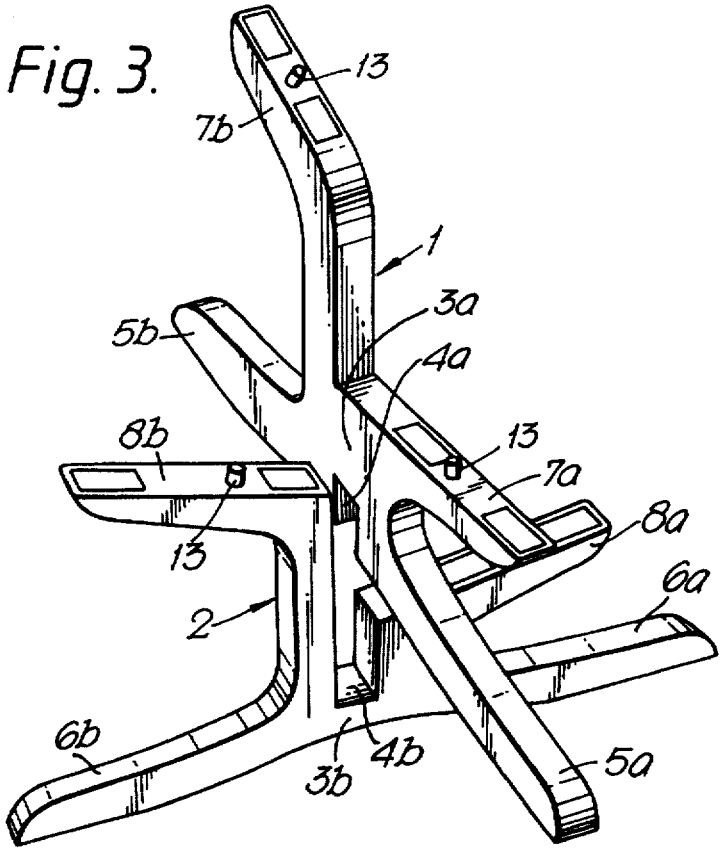
FIG. 3 is an exploded view illustrating the first and second supporting means of FIG. 1 and FIG. 2, respectively, during assemblage.

The present arrangement used specifically in connection with furniture, especially sitting furniture or relief furniture, may comprise substantially, as appearing from FIGS. 1 and 2, a first supporting means 1 and a second supporting means 2, each of which comprising an area 3*a* and 3*b*, respectively, having a recess 4*a* and 4*b*, respectively, said recesses 4*a* and 4*b* being adapted such that the supporting means 1 and 2 can be detachably engaged, as this is further illustrated in FIG. 3, for thereby being mutually assembled.

Figure 4:
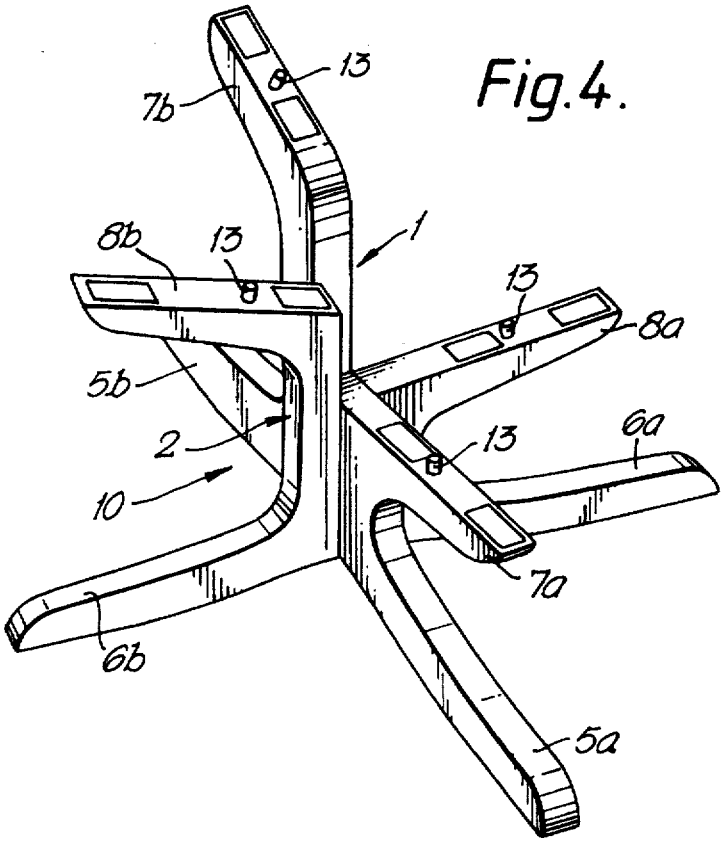
FIG. 4 is a perspective view illustrating the first and second supporting means in assembled condition.

As appearing from said FIGS. 1 and 2, the first supporting means 1 comprising a first lower leg element pair 5*a*, 5*b*, whereas the second supporting means 2 in a similar manner comprises a lower leg element pair 6*a*, 6*b*. Further, the first supporting means 1 comprises an intermediate arm element 7*a* extending outwardly in a first direction, namely in the same direction as one of the lower legs 5*a*, as well as an upper arm element 7*b* extending outwardly in substantially the opposite direction of the intermediate arm element 7*a*. Correspondingly, the second supporting element 2 comprises an intermediate arm element 8*a* and an upper arm element 8*b*. When the two supporting means 1 and 2 are assembled by letting the corresponding recesses 3*a* and 3*b* engage into each other, see FIG. 3, the supporting means 1 and 2 will be detachably engaged in an assembled position to define a post-like structure, see also FIG. 4. This involves that in mounted and assembled position the composite device 10 will comprise four lower leg elements 5*a*, 6*a*, 5*b*, 6*b* in a cross, as well as two intermediate arm elements 7*a*, 8*a* extending outwardly for supporting a first use surface. Besides, the finished assembled device 10 will comprise two upper arm elements 7*b*, 8*b* extending outwardly for supporting a second use surface, for example as this is illustrated in FIGS. 5 and 6.

It is to be understood that the two intermediate arm elements 7*a*, 8*a* and the two upper arm elements 7*b*, 8*b* may extend from the area of the recesses 3*a* and 3*b*, respectively, under any inclination and in any arbitrary direction, and possibly horizontally, for supporting inclined use surfaces, horizontal use surfaces or a combination thereof.

In the embodiment illustrated in FIGS. 1–6 there is illustrated a first supporting surface 11 which is supported by the upper pair of arm element 7*b*, 8*b*, this supporting surface 11 constituting an inclined seat area, whereas the second at a lower level arranged use surface 12 which is mounted on the intermediate pair of arm elements 7*a*, 8*a*, may constitute an inclined calf support, especially in connection with a sitting furniture structure for kneeling-like sitting position ("Balans").

Figure 5:
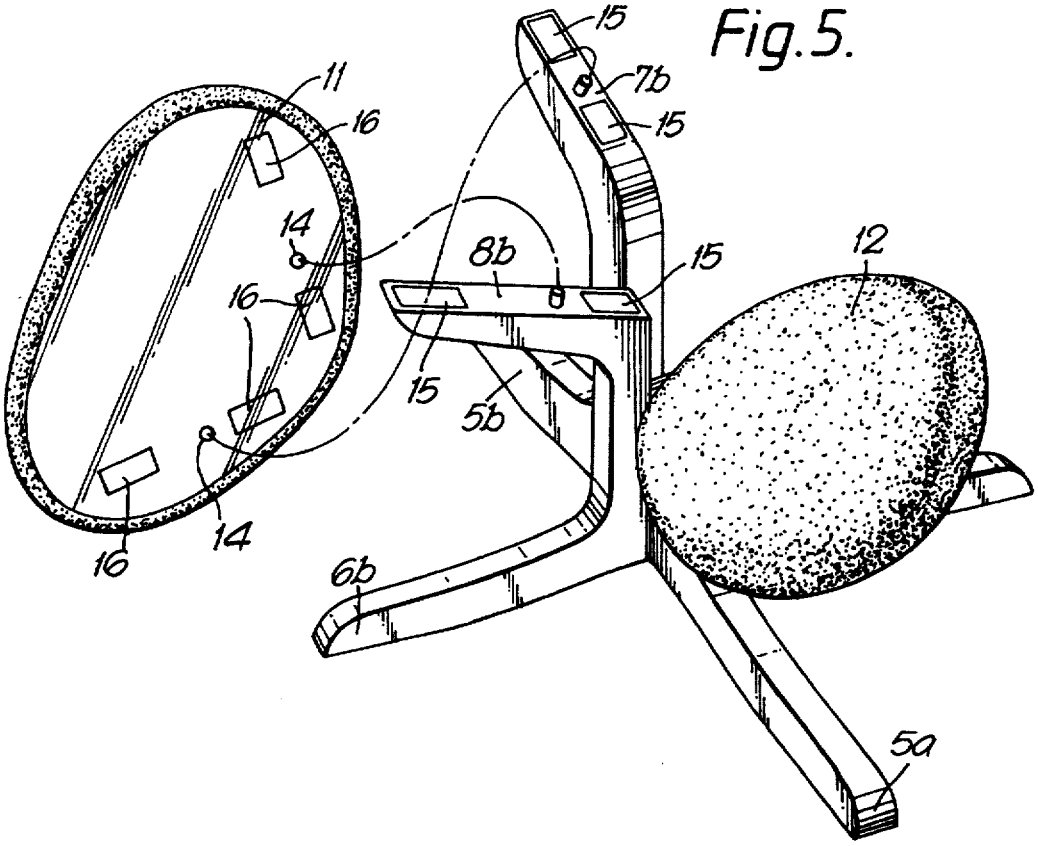
FIG. 5 is a perspective view illustrating the first and second supporting means in assembled condition, the respective leg elements being equipped with use surfaces.
Figure 6:
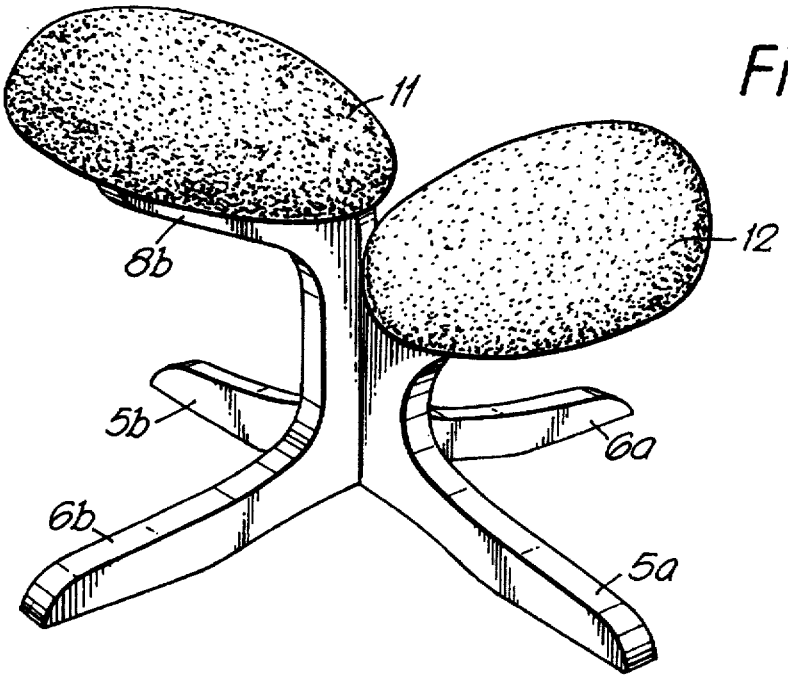
FIG. 6 is a perspective view similar to FIG. 5, and illustrates the first and second supporting means with use surfaces mounted thereon.

Possibly, the embodiment illustrated in FIGS. 5 and 6 may comprise a chair back which possibly can be attached to prolonged upper leg elements, or in any other appropriate manner.

It is to be understood that the described supporting means can appropriately be made of wood, especially if the furniture structure should be included as a piece of an existing housing environment, and it could then be appropriate that the areas 3*a*, 3*b* in the vicinity of recesses 4*a*, 4*b* were made as laminates for strengthening the materials therearound. However, it is to be understood that such supporting means can also be made in mouldable materials having an appropriate strength and surface treatment. Further, it is to be understood that the individual upper and intermediate arm elements may be provided with attachment means for preferably detachable engagement of respective use surfaces, for example attachment means comprising plugs 13 and/or holes 14 fitting corresponding holes or plugs at the bottom side of the use surfaces 11 or 12. Possibly, such attachment means may comprise hook-and-loop locks 15 and/or other corresponding locks made of plastic and provided as bands or strips, possibly in combination with the mentioned attachment means or suitable screw means. Corresponding attachment means 16 can be arranged on the bottom side of the respective use surfaces.

Further, it is to be understood that the respective lower leg elements 5*a*, 5*b* and 6*a*, 6*b* for each supporting means 1 and 2 can substantially have the same extension of length, whereas the respective intermediate arm elements for each supporting element 7*a* and 8*a*, respectively, may have a somewhat shorter extension than the lower leg elements, but substantially the same extension of length as the upper arm elements 7*b* and 8*b*, respectively.

Of course, these dimensions can be varied within wide ranges.

Further, the recesses 4*a*, 4*b* of the respective supporting elements 1 and 2 may be adapted such that the two supporting elements 1 and 2 in mounted assembled position may be arranged substantially in right angle in relation to each other, but it should also be understood that the recesses can be adapted such that the supporting elements may deviate from their 180° position in relation to each other, such deviation accounting for example approximately 5°–10°. Of course, this deviation may vary within wide ranges, because in connection with the present arrangement there is achieved a stable and effective joining of the supporting elements because the use surfaces interconnect the intermediate and upper outwardly extending arm elements.

The intermediate arm elements may be positioned as far down on each support element as possible so as to be closely adjacent the area of the support member recess. With this arrangement, the length of the moment arm for each intermediate arm element is as short as possible, to minimize stresses and deflection during use when the support elements are assembled.

This embodiment may be especially appropriate if the support arrangement is used in connection with an article of furniture such as a high bar stool, where it is desirable to provide as little deflection as possible in the area at which the support elements are interconnected with each other.

An alternative embodiment of the arrangement according to the invention may involve that the two pairs of intermediate and upper arm element pairs may be tied together with a common use surface, for example a substantially continuous use surface having two different levels or use surfaces having mutually substantially merging levels. Appropriately, the arrangement may be used for example as a small step, pedestal, flower stand or auxiliary table.

Figure 7:
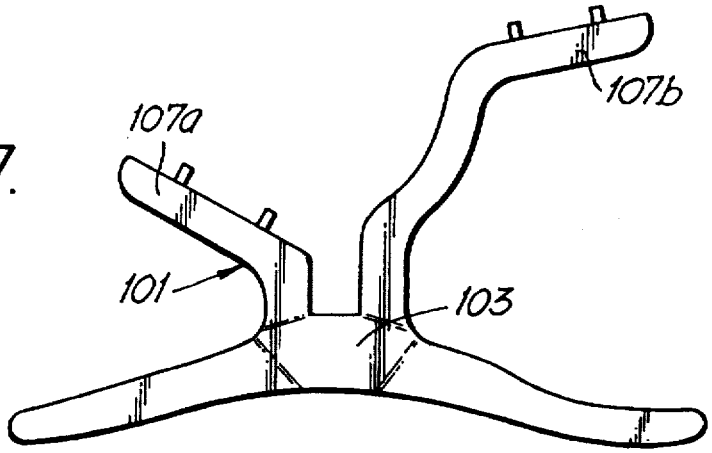
FIG. 7 is a front view of a variant of an embodiment of a supporting means according to the invention.

In FIG. 7 there is illustrated a variant of a supporting means 101 in which especially the area of the recesses is designated by reference numeral 103, this area 103 possibly being laminated, especially if the supporting means is made of wood. Besides, FIG. 7 illustrates an obliquely outwardly protruding intermediate arm element 107*a* and an obliquely protruding upper arm element 107*b*, which involves that the supporting means can be used together with a corresponding supporting means for supporting inclined use surfaces at various levels, especially in connection with furniture of the type "Balans".

Figure 8:
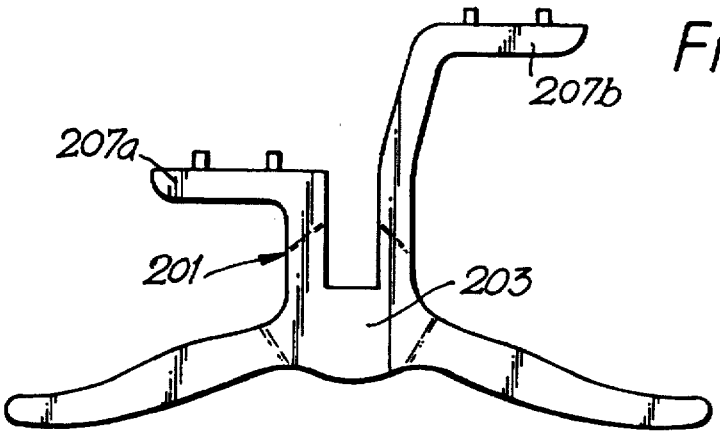
FIG. 8 is a front view of a further embodiment of a supporting means according to the invention.

In FIG. 8 there is illustrated a supporting means 201 having an intermediate arm element 207*a* protruding substantially horizontally from the area of the recess, and an upper arm element 207*b* protruding substantially from the area of the recess 203, but at a higher level. Together with a corresponding supporting means a pair of upper protruding arm elements can thus define support for a first upper use surface which in turn may constitute a supporting surface for a monitor, for example, whereas the lower pair of arm elements may support a lower use surface which for example may carry a keyboard, especially if the finished furniture structure is contemplated used for terminal equipment, or similar.

Figure 9:
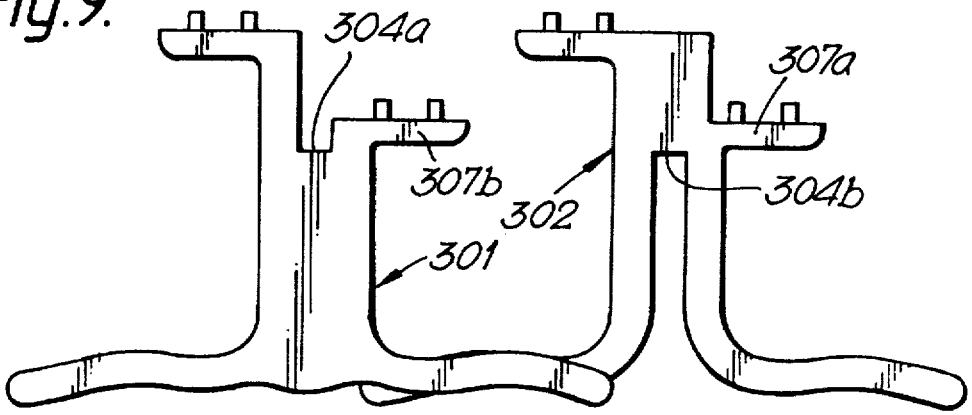
FIG. 9 illustrates a further variant of the supporting means according to the invention.

FIG. 9 illustrates further variants of supporting means 301, 302 according to the present invention, in which the recesses 304*a* and 304*b* are provided at a relatively high level above the floor, but in which the respective intermediate protruding arm elements 307*a* and 307*b*, respectively, are provided as close to the area of the recesses as possible, for thereby achieving a stable interconnection with a not illustrated lower use surface.

According to what has been disclosed specific emphasize has been given to devise supporting means rendering a specifically stable finished assembled structure, the applied use surfaces aiding in stabilizing the leg or arm elements of the supporting means in mutual relationship.

Further, it has been emphasized that the disclosed supporting means may constitute a base for two use surfaces which can have different levels and have different mutual inclinations in relation to each other.

Figure 10:
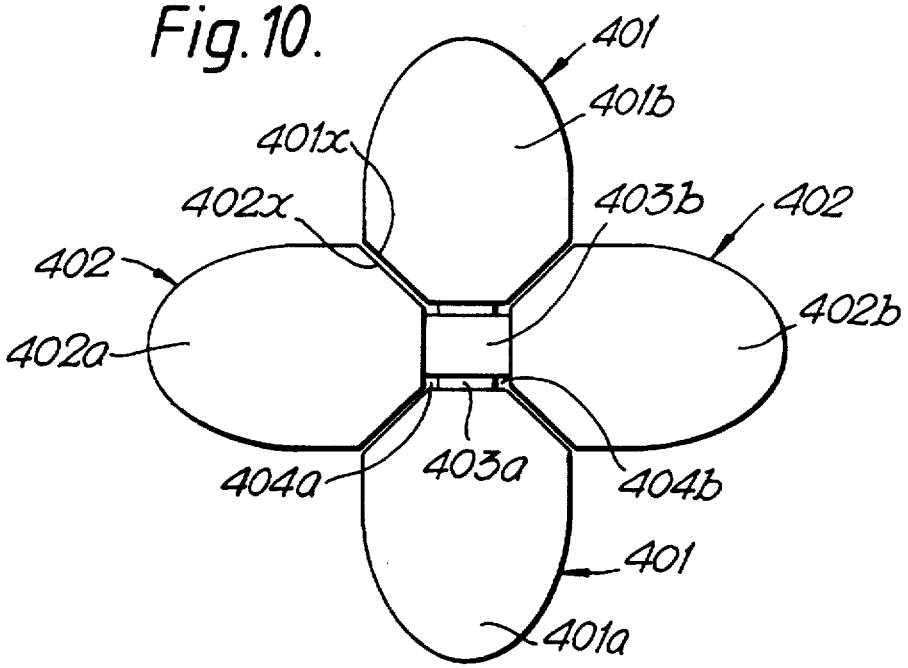
FIGS. 10 and 11 are a section through and a side view of, respectively, a specific embodiment of a structural element according to the present invention.
Figure 11:
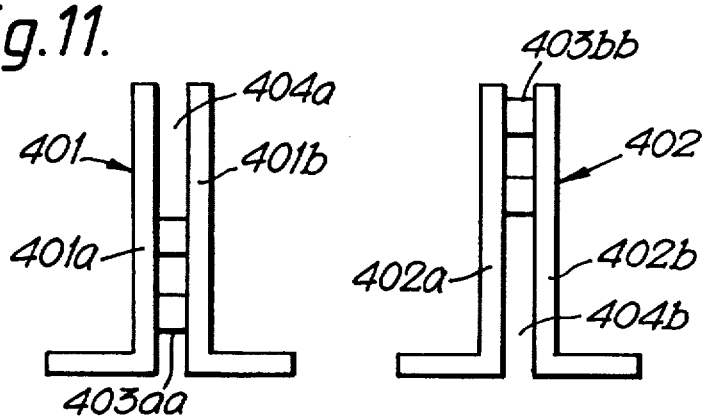

In a further development, this will still be founded on, as appearing from FIGS. 10 and 11, a first supporting means 401 constituted by a pair of elongated members or elements 401*a* and 401*b*, as well as second supporting means 402 constituted by a second pair of elongated members or elements 402*a* and 402*b*. Both supporting means 401 and 402 comprise a separate recess 404*a* and 404*b*, respectively, which are so adapted that the supporting means 401 and 402 may be detachably engaged for mutual assemblage, the pair-like arranged members 401*a*, 401*b* and 402*a*, 402*b*, respectively, being interconnected by means of guiding plugs 403*a* and 403*b*, respectively, see especially FIG. 11.

As appearing from FIG. 10, each of the elongated members 401*a*, 401*b*, 402*a*, 402*b* are provided with appropriate inclined surfaces 401*x* and 402*x*, respectively, which inclined surfaces 401*x*, 402*x* in connection with mutually mounted members 401 and 402 will contact each other and thus stabilize these supporting means 401 and 402 in relation to each other, especially as regards mutual rotating movement.

These inclined abutment surfaces 401*x* and 402*x* will thus devise supporting means 401 and 402 rendering a specifically stabile finished assembled structure, and will of course aid in further stabilization of the object in connection with which the building structure is to be used, when elongated elements of different pairs of respective supporting means, for example the elements or members 401*b* and 402*b*, respectively 401*a* and 402*a*, are mutually interconnected by means of different use surfaces which, as will be explained in the following, can be mounted at different levels and as such form different inter-related angles and in relation to for example a horizontal plane.

Figure 12:
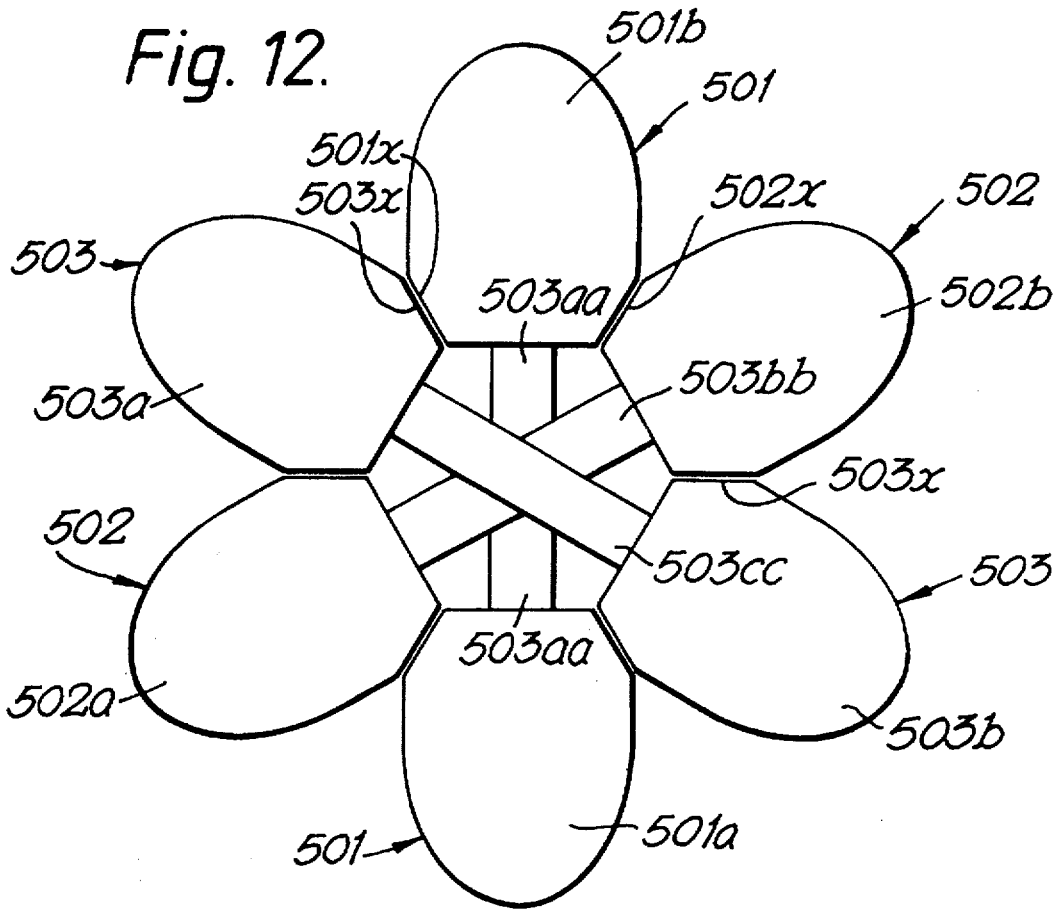
FIGS. 12 and 12A are a section through and a side view of, respectively, a further specific embodiment of a structural element according to the present invention.
Figure 12A:
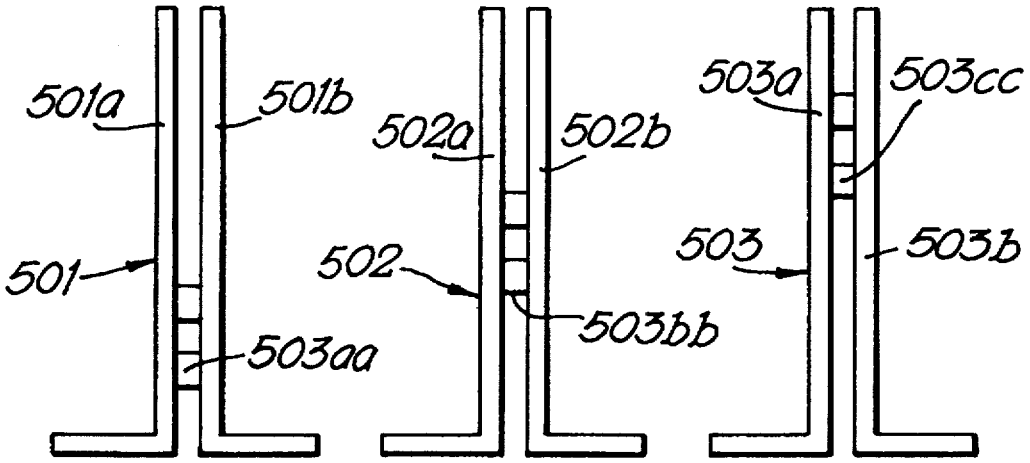

In FIGS. 12 and 12A there is illustrated an embodiment which also comprises the fundamental principle discussed in connection with FIG. 10, but which is not limited to two supporting elements, but which is here disclosed with three supporting elements 501, 502 and 503, respectively.

Also here the first supporting element 501 is composed of a pair of elongated members or elements 501*a* and 501*b*, respectively, whereas the second supporting means 502, in a similar manner, is composed of a second pair of elongated members 502*a* and 502*b*, respectively, whereas the third supporting means 503 is composed of its own pair of elongated members 503*a* and 503*b*, respectively.

All of the elongated members or elements are also here provided with inclined abutment surfaces 501*x*, 502*x* and 503*x*, respectively, which in the same manner as discussed in connection with FIG. 10, will contribute to a very stabile structure as regards twisting when the respective pair of elements for each supporting means is assembled to a fundamental structure of the type illustrated in FIG. 12. In FIG. 12 it is further illustrated that the respective pair of members or elements included in the respective supporting means are originally composed to pairs by means of for example guiding plugs 503*aa*, 503*bb* and 503*cc*, respectively. It is to be understood that these guiding plugs can be arranged at different levels, see especially FIG. 12A, such that the respective pairs can detachably be engaged for mutual assemblage, as illustrated for example in FIG. 12.

Besides, it is to be understood that the discussed guiding plugs may be substituted by binding means which can be mounted on site, for example by having the guiding plugs shipped separated, together with separated members or elements, and otherwise it may be contemplated that guiding plugs can be substituted by through-going pipes, wire or similar for pair-like assemblage directly on the building site or the site of use.

In FIGS. 13, 14 and 15 there is illustrated an embodiment of the present further development including three use surfaces, FIG. 13 illustrating the embodiment in side view, FIG. 14 illustrating the embodiment in front view, whereas FIG. 15 illustrates the embodiment as seen from above, but with the upper plate or use surface removed.

In FIG. 15 the structure as diagrammatically illustrated in FIG. 10 will be recognized, FIG. 15 illustrating the first supporting means 601 and the second supporting means 602 including their specific profiled element pairs 601*a*, 602*a* and 602*a*, 602*b*, respectively, these elements being provided with inclined adjoining surfaces 601*x* and 602*x*, respectively.

In the embodiment illustrated in FIGS. 13–15 each of the supporting means 601, 602, respectively, is provided with lower leg element pairs, 605*a*, 605*b* and 606*a*, 606*b*, protruding in different directions, such that the four lower leg elements form a cross aiding in carrying the construction itself on a base, in this case for example a floor.

Differently from what has been disclosed in connection with the FIGS. 1–9, there is here not used arm elements which are mounted as an integral part of the various supporting means, but the present further development is nevertheless so adapted that two and two, possibly more, elongated elements may support different use surfaces at the same time as different pairs of elements or members are further connected by means of a use surface whilst simultaneously carrying the latter.

Thus, on FIGS. 13–14 there is illustrated a first use surface 612 which is attached to different pairs of supporting means elements, here elements 601*a* and 602*a*, as this appears from FIG. 15, the first use surface 612 being provided with a cut-out 612*a* allowing for the use surface 612 to be threaded onto the respective different pairs of supporting means elements 601*a*, 602*a* to appropriate stepless height, at the same time as the use surface 612 at a suitable height is affixed by means of a holding means, for example a protrusion in the form of a wedge-like means 613.

This affixing principle is more specifically illustrated in FIG. 16 which depicts further details in perspective of the disclosed first use surface 612, the latter by means of its cut-outs 612*a* encircling the respective different pairs of supporting means elements 601*a*, 602*a* through a wedge-like means 613. This principle is further illustrated in the simplified side view illustrated in FIG. 17, which is to be read in connection with the previously discussed FIG. 16.

Besides, in FIGS. 13–15 there is illustrated a second use surface 611 which can be attached in the same manner as the previously discussed use surface 612, see otherwise FIG. 16 and the discussion thereof.

Finally, in FIGS. 13 and 14 there is illustrated an upper use surface 610 which can be a top surface, i.e. a surface which appropriately can be provided with carvings in the bottom side, which carvings fit the projective profile illustrated in FIG. 15, wherein the top surface 610 is removed, the top surface 610 otherwise being affixed at the top of the structure by means of an appropriate wedge-like means of the same type at the previously discussed wedge means 613.

It is to be understood that the discussed further development can be implemented with a free number of pairs of mutually connected supporting means elements or members, at least two such pairs being assembled to arbitrarily mutually assembled supporting means, and the number of such pairs of supporting means elements only being limited by the practical conditions on the site of use.

Further, it is to be understood that such supporting means do not need to comprise vertically extending supporting means elements, but can also Comprise obliquely extending elements, when the field of application should so dictate due to practical or structural reasons.

We claim:

1. A structural furniture arrangement, comprising:

a first support member having a pair of legs extending in opposite directions and including an upwardly facing recess;

a second support member having a pair of legs extending in opposite directions and including a downwardly facing recess;

wherein the first and second support members are engageable with each other such that a portion of the first support member is received in the second support member recess and a portion of the second support member is received in the first support member recess;

an upper use surface support structure located above the legs of each of the first and second support members for supporting a first use surface at a first elevation above the legs when the first and second support members are engaged with each other; and a lower use surface support structure located above the legs of each of the first and second support members and below the upper use surface support structure for supporting a second use surface at a second elevation between the first use surface and the legs of the first and second support members when the first and second support members are engaged with each other;

wherein the first and second support members each define a pair of spaced vertical members, wherein the legs extend one from each of the vertical members, and wherein the vertical members are connected together via plug structure disposed between and interconnected with the vertical members.

2. The arrangement of claim 1, wherein the first and second support members each include a central area from which its associated legs extend, and wherein the recess of each of the first and second support members is formed in the support member central area.

3. The arrangement of claim 1, wherein the upper use surface support structure defines horizontal upwardly facing engagement surfaces for orienting the first use surface horizontally when the first use surface is mounted to the upper use surface support structure.

4. The arrangement of claim 1, wherein the lower use surface support structure defines horizontal upwardly facing engagement surfaces for orienting the second use surface horizontally when the second use surface is mounted to the lower use surface support structure.

5. The arrangement of claim 1, wherein the legs of each support member are of substantially equal length, and wherein the upper and lower use surface support structures of the support members are substantially equal in length to each other and are shorter in length than the legs of the support member.

6. The arrangement of claim wherein the lower use surface support structure comprises an arm extending from a location closely adjacent the terminus of the support member recess so as to minimize the length of the moment arm between the arm and the portion of the support member from which the arm extends.

7. The arrangement of claim 1, wherein the first and second support members define facing, angled abutment surfaces which engage each other when the first and second support members are engaged with each other, wherein the abutment surfaces of each support member are non-parallel to a vertical, longitudinal plane along which the support member extends and are non-parallel to a vertical transverse plane perpendicular to the longitudinal plane.

8. A structural furniture arrangement, comprising:

a first support member having a pair of legs extending in opposite directions and including an upwardly facing recess;

a second support member having a pair of legs extending in opposite directions and including a downwardly facing recess;

wherein the first and second support members are engageable with each other such that a portion of the first support member is received in the second support member recess and a portion of the second support member is received in the first support member recess;

wherein the first and second support members define facing, angled abutment surfaces which engage each other when the first and second support members are engaged with each other, wherein the abutment surfaces of each support member are non-parallel to a vertical, longitudinal plane along which the support member extends and are non-parallel to a vertical transverse plane perpendicular to the longitudinal plane;

wherein each support member comprises a pair of spaced vertical members from which the legs extend, wherein the abutment surfaces are formed on the spaced vertical members, and wherein the spaced vertical members are connected together via plug structure disposed between and connected with the vertical members.

9. The arrangement of claim 8, wherein the recess of each support member is defined by the plug structure in combination with facing surfaces defined by the spaced vertical members.

10. The arrangement of claim 8, wherein the first and second support members and their associated recesses are formed and constructed such that the support members are oriented at right angles to each other when the support members are engaged with each other.

11. A structural furniture arrangement, comprising:

a post member having an outer surface defining one or more indentations extending along a longitudinal axis defined by the post member, wherein the post member comprises first and second support members, each of which includes a pair of legs extending in opposite directions, wherein one of the support members includes an upwardly facing recess and the other of the support members includes a downwardly facing recess, wherein the first and second support members are engageable with each other such that a portion of the first support member is received in the second support member recess and a portion of the second support member is received in the first support member recess;

a series of outwardly extending legs mounted to the post member and extending outwardly from a lower end defined by the post member;

a use surface mountable to the post member and having an opening which receives at least a portion of the post member, the use surface including a protrusion defining a portion of the opening for engaging at least one of the indentations; and an adjustable support member interconnected with the use surface and the post member for fixing the vertical position of the use surface relative to the support member.

12. The arrangement of claim 11, wherein each support member comprises a pair of spaced vertical members from which the legs extend, wherein the spaced vertical members are connected together via plug structure disposed between and connected with the vertical members.

13. The arrangement of claim 11 wherein the first and second support members define facing, angled abutment surfaces which engage each other when the first and second support members are engaged with each other, wherein the abutment surfaces of each support member are non-parallel to a vertical, longitudinal plane along which the support member extends and are non-parallel to a vertical transverse plane perpendicular to the longitudinal plane.

14. The arrangement of claim 11, wherein the first and second support members cooperate to define a post member having a lobed cross-section, wherein the post member indentations are located between adjacent lobes, wherein each support member is constructed so as to form two opposed lobes in the post member.

15. The arrangement of claim 11, wherein the use surface opening extends completely through the use surface to enable the use surface to be slid longitudinally in a direction parallel to the longitudinal axis of the post member.

16. The arrangement of claim 15 wherein the opening is formed so as to extend inwardly from an edge of the use surface.

17. The arrangement of claim 11, wherein the adjustable support member comprises a wedge member connected to the use surface and engageable within one of the indentations defined by the post member.

18. A structural furniture arrangement, comprising:

a post member formed of at least three interconnected support members, wherein each support member comprises a pair of spaced vertical members interconnected via plug structure, wherein the plug structure of the support members is positioned so as to define recesses between the vertical members of the support members which enable the support members to be engaged with each other such that the plug structure of each support member is disposed within one of the recesses defined by each of the other support members;

a series of legs interconnected with and extending outwardly from lower ends defined by the support members; and one or more use surfaces secured to the post member.

19. The arrangement of claim 18, wherein the spaced vertical members each define facing, angled abutment surfaces which engage each other when the support members are engaged with each other, wherein the abutment surfaces defined by each spaced vertical member are non-parallel to a vertical, longitudinal plane along which the support member extends and are non-parallel to a vertical transverse plane perpendicular to the longitudinal plane.

* * * * *

UNITED STATES PATENT AND TRADEMARK OFFICE

CERTIFICATE OF CORRECTION

PATENT NO. : 5,615,621

DATED : April 1, 1997

INVENTOR(S) : HANS CHR. MENGSHOEL ET AL

It is certified that error appears in the above-identified patent and that said Letters Patent is hereby corrected as shown below:

On the title page:

[54] Title: After "ELEMENT" insert -- , --; delete "SPECIALLY" and substitute therefor -- SPECIFICALLY --;

Claim 6, col. 9, line 5, after "claim" insert -- 1, --; Claim 13, col. 10, line 19, after "11" insert -- , --; Claim 15, col. 10, line 36, after "15" insert -- , --.

Signed and Sealed this

Twenty-ninth Day of July, 1997

Bruce Lehman

*Attest:*

BRUCE LEHMAN

*Attesting Officer*

*Commissioner of Patents and Trademarks*